US010569492B2

(12) United States Patent
Nakano et al.

(10) Patent No.: US 10,569,492 B2
(45) Date of Patent: Feb. 25, 2020

(54) BINDING PROCESSING DEVICE

(71) Applicant: FUJI XEROX CO., LTD., Tokyo (JP)

(72) Inventors: Yoshinori Nakano, Kanagawa (JP); Hiroaki Awano, Kanagawa (JP); Takuya Makita, Kanagawa (JP); Kojiro Tsutsumi, Kanagawa (JP); Katsumi Harada, Kanagawa (JP); Yasuhiro Kusumoto, Kanagawa (JP); Hiroshi Hagiwara, Kanagawa (JP); Emiko Shiraishi, Kanagawa (JP); Junichi Hirota, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/036,235

(22) Filed: Jul. 16, 2018

(65) Prior Publication Data

US 2018/0319119 A1 Nov. 8, 2018

Related U.S. Application Data

(63) Continuation of application No. 15/223,644, filed on Jul. 29, 2016, now Pat. No. 10,046,535.

(30) Foreign Application Priority Data

Mar. 29, 2016 (JP) ..... 2016-066599

(51) Int. Cl.
*B31F 5/02* (2006.01)
*B65H 37/04* (2006.01)
(Continued)

(52) U.S. Cl.
CPC ..... *B31F 5/02* (2013.01); *B42B 5/00* (2013.01); *B42C 1/12* (2013.01); *B65H 37/04* (2013.01);
(Continued)

(58) Field of Classification Search
CPC ..... B31F 1/00; B31F 5/00; B31F 5/02; B65H 37/04; B65H 2301/43828;
(Continued)

(56) References Cited

U.S. PATENT DOCUMENTS 8,657,596 B2 2/2014 Lake et al.
8,845,258 B2 9/2014 Mori
(Continued)

FOREIGN PATENT DOCUMENTS

JP 2010-208854 A 9/2010
JP 5361858 B2 12/2013

OTHER PUBLICATIONS

Communication dated May 25, 2018 from the State Intellectual Property Office of the P.R.C. In counterpart application No. 201610814744.6.
(Continued)

*Primary Examiner* — Leslie A Nicholson, III
(74) *Attorney, Agent, or Firm* — Sughrue Mion, PLLC

(57) ABSTRACT

A binding processing device includes a first pressing member including: a first convex portion; a first concave portion; and a first connection portion which is provided between the first convex portion and the first concave portion; and a second pressing member including: a second convex portion; a second concave portion; and a second connection portion which is provided between the second convex portion and the second concave portion. In a state in which the first convex portion of the first pressing member and the second concave portion of the second pressing member come in contact with each other at the first connection portion and the second connection portion, the first connection portion contacts with the second connection portion and a gap is formed between the first convex portion and the second concave portion along a pressing direction of the first
(Continued)

and second pressing members. In a state in which a sheet bundle is sandwiched between the first pressing member and the second pressing member, an increased section having an increased thickness of each sheet of the sheet bundle is formed in the gap. The increased section is pressed by the first convex portion and the second concave portion.

5 Claims, 8 Drawing Sheets

(51) Int. Cl.
*B42B 5/00* (2006.01)
*B42C 1/12* (2006.01)
*G03G 15/00* (2006.01)

(52) U.S. Cl.
CPC ..... *G03G 15/6544* (2013.01); *B65H 2301/51616* (2013.01); *B65H 2408/1222* (2013.01); *B65H 2801/27* (2013.01); *G03G 2215/00822* (2013.01)

(58) Field of Classification Search
CPC ..... B65H 2301/51616; G03G 2215/00852; G03G 15/6544
USPC ..... 270/58.07, 58.08; 493/390
See application file for complete search history.

(56) References Cited

U.S. PATENT DOCUMENTS

| | | | |
|---|---|---|---|
| 8,983,362 | B2 | 3/2015 | Nakamura |
| 9,315,356 | B2 | 4/2016 | Yoshida et al. |
| 2010/0202814 | A1 | 8/2010 | Nakamura |
| 2014/0138896 | A1 | 5/2014 | Yoshida et al. |
| 2015/0076759 | A1 | 3/2015 | Kosuge et al. |
| 2015/0239587 | A1 | 8/2015 | Abe |

OTHER PUBLICATIONS

Communication dated Jan. 7, 2020 from Japanese Patent Office in counterpart application No. 2016-066599.

BINDING PROCESSING DEVICE

CROSS-REFERENCE TO RELATED APPLICATIONS

This application is continuation application of U.S. application Ser. No. 15/223,644, filed Jul. 29, 2016, which is based on and claims priority under 35 USC 119 from Japanese Patent Application No. 2016-066599 filed Mar. 29, 2016.

BACKGROUND

Technical Field

The present invention relates to a binding processing device.

SUMMARY

According to an aspect of the invention, there is provided a binding processing device including:

a first pressing member that includes a convex portion formed by a curved surface with a curvature and protruding toward a sheet bundle in which plural sheets are stacked; and a second pressing member that includes a concave portion formed by a curved surface with a curvature and configured to be combined with the convex portion through the sheet bundle, the second pressing member configured to press the sheet bundle sandwiched between the first pressing member and the second pressing member, wherein in a state in which the convex portion of the first pressing member and the concave portion of the second pressing member are combined with each other, a gap is formed between the convex portion and the concave portion in a cross section of the first pressing member and the second pressing member along a pressing direction, and the gap has a volume larger than a volume of the sheet bundle sandwiched between the convex portion and the concave portion.

BRIEF DESCRIPTION OF THE DRAWINGS

Exemplary embodiments of the present invention will be described in detailed based on the following figures, wherein.

DETAILED DESCRIPTION

Exemplary Embodiment 1

Hereinafter, exemplary embodiments of the present invention will be described in detail with reference to the accompanying drawings.

<Image Forming System 1>

Figure 1:
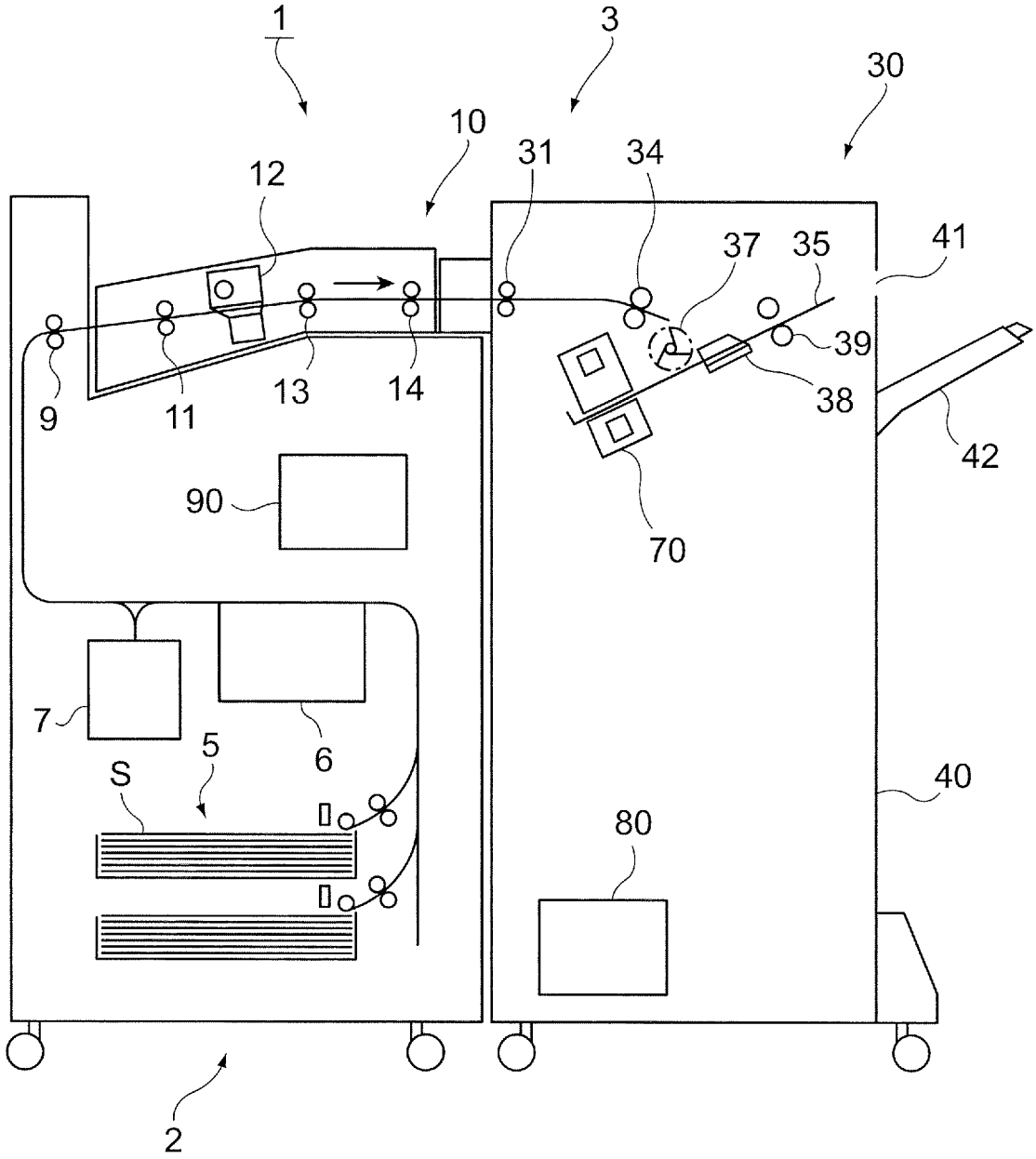
FIG. 1 is a view illustrating an outline of an image forming system to which Exemplary Embodiment 1 of the present invention is applied.

FIG. 1 is a view illustrating an outline of an image forming system 1 to which Exemplary Embodiment 1 is applied. The image forming system 1 illustrated in FIG. 1 includes an image forming apparatus 2, such as a printer or a copier, that forms an image by, for example, an electrophotographic method, and a sheet processing device 3 that performs a post-processing for a sheet S on which, for example, a toner image is formed by the image forming apparatus 2.

<Image Forming Apparatus 2>

The image forming apparatus 2 includes a sheet supply unit 5 that supplies a sheet S to be formed with an image thereon, and an image forming unit 6 that forms an image on the sheet S supplied from the sheet supply unit 5. Further, the image forming apparatus 2 includes a sheet reversing device 7 that reverses the face of the sheet S on which an image has been formed by the image forming unit 6, and exit rolls 9 that discharge the sheet S formed with the image thereon. Further, the image forming apparatus 2 includes a user interface 90 that receives information about the binding processing from a user.

<Sheet Processing Device 3>

The sheet processing device 3 includes a transport device 10 that transports sheets S output from the image forming apparatus 2 further to a downstream side, and a post-processing device 30 that includes, for example, a compiling tray 35 configured to collect and bundle the sheets S and a needle-free binding mechanism 70 configured to bind the ends of the sheets S. Further, in the illustrated example, the sheet processing device 3 includes a controller 80 that controls the entire image forming system 1.

The transport device 10 of the sheet processing device 3 includes entrance rolls 11, which are a pair of rolls, and a puncher 12. The entrance rolls 11 receive the sheet S output through the exit rolls 9 of the image forming apparatus 2. The puncher 12 punches the sheet S received by the entrance rolls 11 as needed. Further, the transport device 10 includes first transport rolls 13 that are a pair of rolls configured to transport the sheet S further to the downstream side of the puncher 12, and second transport rolls 14 that are a pair of rolls configured to transport the sheet S toward the post-processing device 30.

<Post-Processing Device 30>

Figure 2:
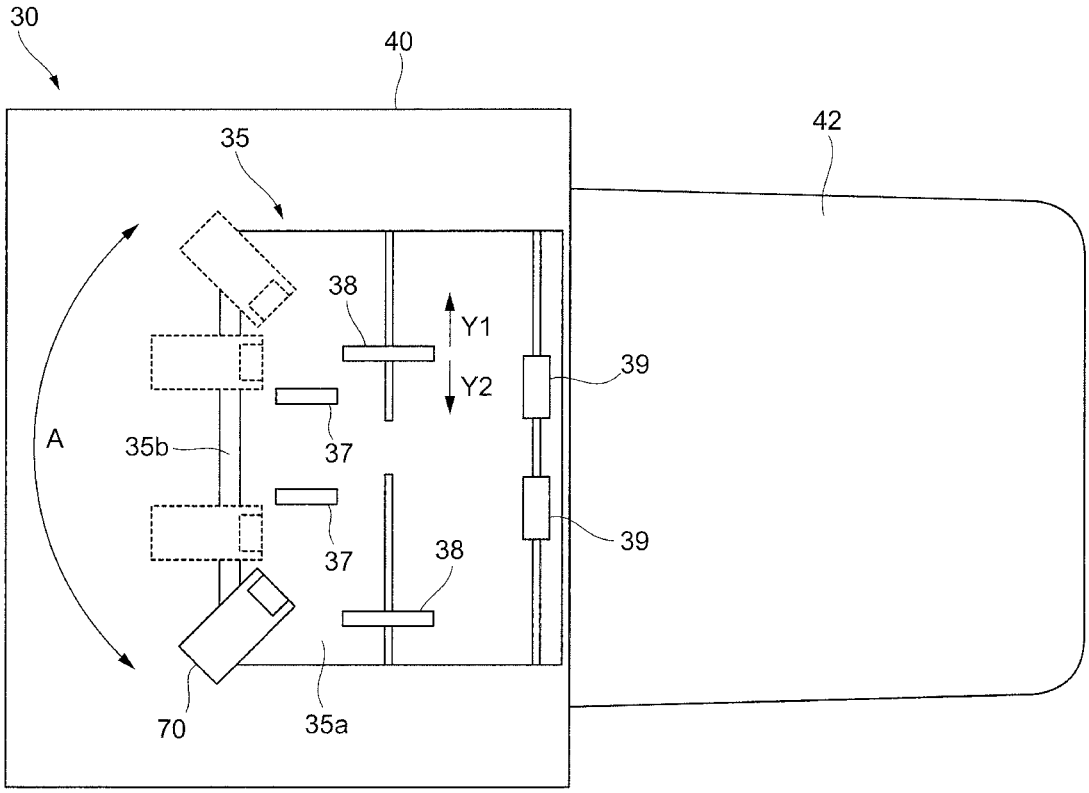
FIG. 2 is a view of a post-processing device when viewed from the top side in the direction orthogonal to a surface of a sheet to be transported.

FIG. 2 is a view of the post-processing device 30 when viewed from the top side in the direction orthogonal to the surface of the sheet S to be transported. Subsequently, the post-processing device 30 will be described with reference to FIGS. 1 and 2.

The post-processing device 30 of the sheet processing device 3 is an exemplary binding processing device, and includes reception rolls 31 that receive the sheet S from the transport device 10 and exit rolls 34 that transport the sheet S received by the reception rolls 31 further to a downstream side. Further, the post-processing device 30 includes the compiling tray 35 that accumulates the sheets S each formed with an image thereon by a predetermined number. As illustrated in FIG. 2, the compiling tray 35 includes a bottom unit 35*a* that has atop surface on which the sheets S are stacked, and an end guide 35*b* that is formed on a surface intersecting with the bottom unit 35*a* and aligns the ends of the sheets S in the transport direction of the sheets S when generating a sheet bundle.

Further, the post-processing device 30 includes a paddle 37 that is rotated to push the sheets S toward the end guide 35*b* of the compiling tray 35, and a damper 38 that positions the opposite ends of the sheets S accumulated on the compiling tray 35 (the opposite ends of the sheets S in the direction intersecting with the transport direction of the sheets S).

Further, the post-processing device 30 includes a needle-free binding mechanism 70 that performs a needle-free binding processing using no staple needle for the sheets S (the sheet bundle) accumulated on the compiling tray 35. The needle-free binding mechanism 70 performs a processing of binding an end of the sheet bundle aligned on the compiling tray 35 by pressing the sheet bundle and rupturing the fibers of the sheets S to be press-bonded to each other without using a staple needle. The configuration of the needle-free binding mechanism 70 and details of the needle-free binding processing will be described later.

Further, the post-processing device 30 includes ejection rolls 39 that press the sheets S accumulated on the compiling tray 35, and are rotated to transport the sheet bundle which has been subject to the needle-free binding processing by the needle-free binding mechanism 70.

Further, the post-processing device 30 includes a case that accommodates the above-described constitutional members therein. The case 40 is formed with an opening 41 to discharge the sheet bundle, which has been subject to the needle-free binding processing by the needle-free binding mechanism 70, to the outside of the post-processing device 30 through the ejection rolls 39.

Further, the post-processing device 30 includes a stacking unit 42 that superimposes sheet bundles discharged from the opening 41 of the case 40 on one another such that the user may easily take the sheet bundles.

Subsequently, descriptions will be made on the sequence of the needle-free binding processing performed in the post-processing device 30 of the present exemplary embodiment.

A sheet S carried into the post-processing device 30 from the transport device 10 is received by the reception rolls 31, and transported by the exit rolls 34. The transported sheet S is transported toward the compiling tray 35 between the ejection rolls 39 and the paddle 37. The sheet S that has reached the compiling tray 35 is pushed on the compiling tray 35 by the rotation of the paddle 37 such that the rear end of the sheet S abuts against the end guide 35*b* so as to be aligned. The sheet S is received on the compiling tray 35 in this way, and the damper 38 moves in the directions Y1 and Y2 at the timing that the sheet S reaches the end guide 35*b* so as to position the opposite ends of each sheet S.

Subsequently, a predetermined number of sheets S are accumulated on the compiling tray 35, and aligned to generate a sheet bundle. Here, as described above, each sheet S is stacked in a state in which an image-formed face thereof is directed upwards. Then, the needle-free binding mechanism 70 moves to a predetermined binding position, and performs the binding processing.

In addition, in a case where the binding is performed at one place of the sheet bundle on the compiling tray 35, the needle-free binding mechanism 70 stops at a predetermined home position, and sequentially performs the needle-free binding processing at a necessary timing. Meanwhile, in a case where binding is performed at two places of the sheet bundle, the needle-free binding mechanism 70 moves on a rail by a driving force of a driving motor to reach a predetermined binding position (see the arrow A of FIG. 2), and performs the needle-free binding processing for the two places of the sheet bundle.

<Needle-Free Binding Mechanism 70>

Figure 3:
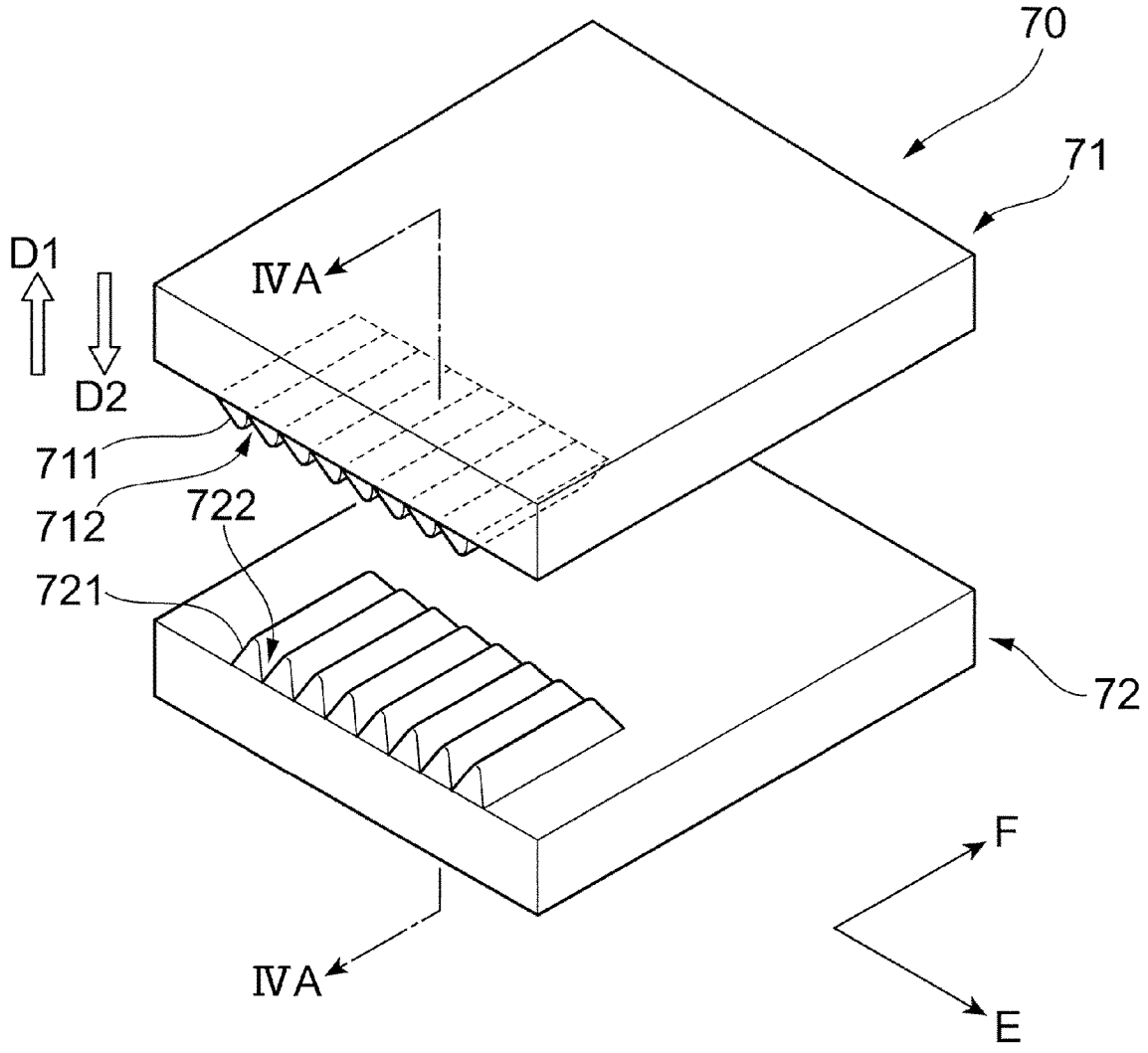
FIG. 3 is a view for explaining a configuration of a needle-free binding mechanism to which Exemplary Embodiment 1 is applied.
Figure 4A:
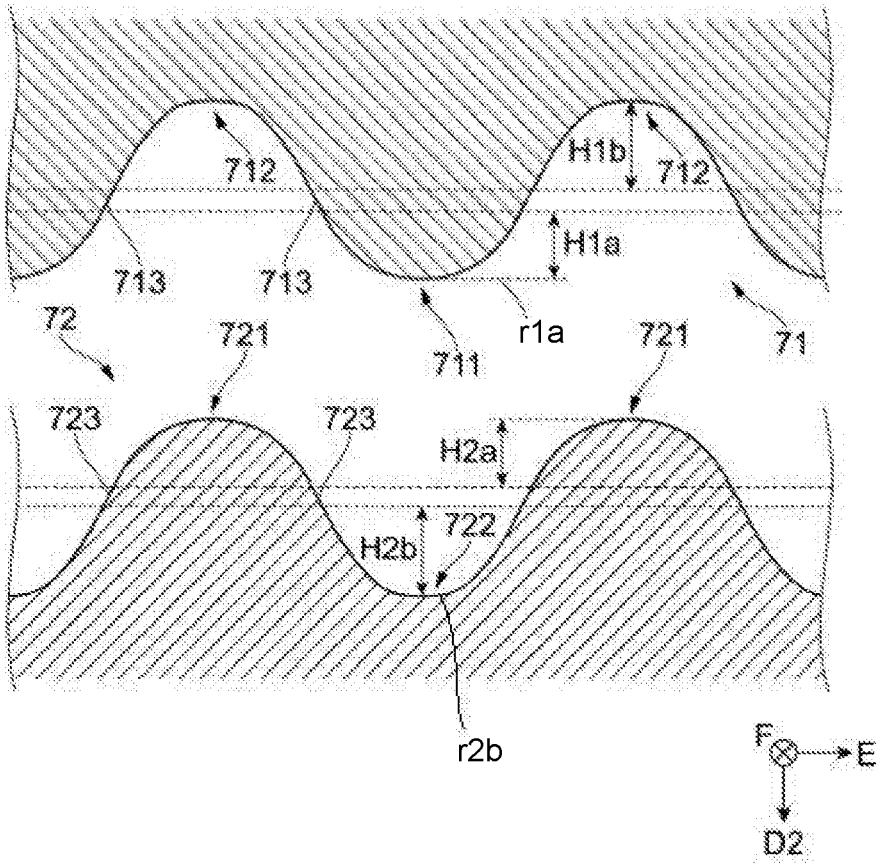
FIGS. 4A and 4B are views for explaining the configuration of the needle-free binding mechanism to which Exemplary Embodiment 1 is applied.
Figure 4B:
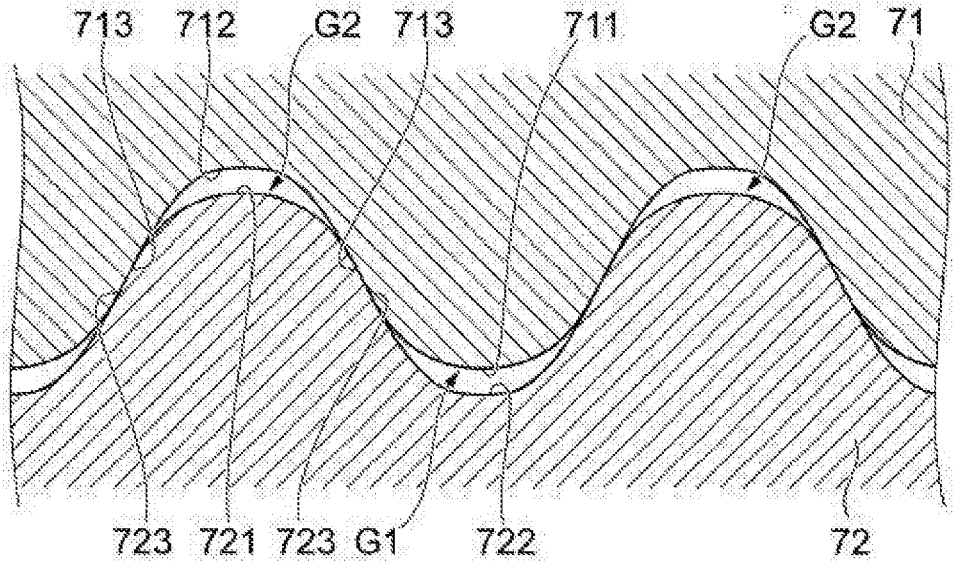

Subsequently, the configuration of the needle-free binding mechanism 70 will be described. FIG. 3 and FIGS. 4A and 4B are views for explaining the configuration of the needle-free binding mechanism 70 to which the present exemplary embodiment is applied. FIG. 3 is a perspective view illustrating an outline of the needle-free binding mechanism 70. FIG. 4A is an enlarged view of the IVA-IVA cross section of a first pressing member 71 and a second pressing member 72 (the cross section along a pressing direction D2 and a parallel direction E) represented in FIG. 3. FIG. 4B is a view illustrating a state in which the first pressing member 71 and the second pressing member 72 illustrated in FIG. 4A are combined with each other.

As illustrated in FIG. 3, the needle-free binding mechanism 70 of the present exemplary embodiment includes the first pressing member 71 and the second pressing member 72 which are an exemplary first member and an exemplary second member, respectively, that are opposite to each other through the sheets (the sheet bundle) stacked on the compiling tray 35 (see FIG. 2) and approach to each other so as to supply a pressure for processing the end of the sheet bundle.

In the needle-free binding mechanism 70 of the present exemplary embodiment, as represented by the arrows D1 and D2 in FIG. 3, the first pressing member 71 is provided to be movable forward and backward with respect to the second pressing member 72 by a driving motor (not illustrated). In addition, the first pressing member 71 and the second pressing member 72 are configured to press the sheet bundle generated on the compiling tray 35.

In addition, in the descriptions below, the direction in which the first pressing member 71 approaches the second pressing member 72 to press the sheet bundle (the direction D2 in FIG. 3; the stacking direction of the sheets) may be simply referred to as the "pressing direction D2").

The first pressing member 71 faces one side (top side) of the sheet bundle stacked on the compiling tray 35 in the stacking direction of the sheets.

The first pressing member 71 includes plural first convex portions 711 as an example of convex portions protruding toward the sheet bundle and plural first concave portions 712 that are recessed in a direction away from the sheet bundle. Each of the plural first convex portions 711 and the plural first concave portions 712 has an elongated shape extending along a predetermined direction. The first convex portions 711 and the first concave portions 712 extend in parallel with each other. Further, the plural first convex portions 711 and the plural first concave portions 712 are alternately arranged in the direction along the image-formed face of each sheet constituting the sheet bundle.

In addition, in the descriptions below, the direction in which the plural first convex portions 711 and the plural first concave portions 712 are arranged (the direction represented by the arrow E in FIG. 3) may be simply referred to as a "parallel direction E," and the direction in which each of the plural first convex portions 711 and the plural first concave portions 712 extends (the direction represented by the arrow F in FIG. 3) may be simply referred to as an "elongated direction F."

In the first pressing member 71 of the present exemplary embodiment, each of the first convex portions 711 and the first concave portions 712 is formed by a curved surface with a curvature. Specifically, each first convex portion 711 is formed by a surface convexly curved toward the second pressing member 72 side. In addition, each first concave portion 712 is formed by a surface concavely curved in a direction away from the second pressing member 72. Accordingly, as illustrated in FIG. 4A, the first convex portions 711 and the first concave portions 712 are represented by curved lines in the cross sections thereof along the pressing direction D2 and the parallel direction E.

In addition, in the first pressing member 71 of the present exemplary embodiment, the cross sectional shape of each of the first convex portion 711 and the first concave portion 712 is constant from one end thereof throughout the other end thereof in the elongated direction F.

In addition, the first pressing member 71 includes a first connection portion 713 that is provided between each of the first convex portions 711 and the counterpart first concave portion 712, and formed by a plane inclined to the pressing direction D2 and the parallel direction E.

Here, in the descriptions below, the distance in the pressing direction D2 from the boundary position between the first convex portion 711 and the first connection portion 713 to the apex of the first convex portion 711 will be referred to as a height H1*a*. Likewise, the distance in the pressing direction D2 from the boundary position between the first concave portion 712 and the first connection portion 713 to the bottom of the first concave portion 712 will be referred to as a depth H1*b*. In this example, the height H1*a* of the first convex portion 711 is smaller than the depth H1*b* of the first concave portion 712 (H1*a*<H1*b*).

The second pressing member 72 faces the other side (bottom side) of the sheet bundle stacked on the compiling tray 35 in the stacking direction of the sheets and is opposite to the first pressing member 71 through the sheet bundle.

The second pressing member 72 includes plural second convex portions 721 and plural second concave portions 722. The second convex portions 721 protrude toward the sheet bundle. The second concave portions 722 are an example of concave portions recessed in a direction away from the sheet bundle. Each of the plural second convex portions 721 and the plural second concave portions 722 has an elongated shape extending along the elongated direction F. The second convex portions 721 and the second concave portions 722 extend in parallel with each other. Further, the plural second convex portions 721 and the plural second concave portions 722 are alternately arranged in the direction along the image-formed face of each sheet constituting the sheet bundle.

In addition, each second convex portion 721 is opposite to the counterpart first concave portion 712 of the first pressing member 71 through the sheet bundle. Likewise, each second concave portion 722 is opposite to the counterpart first convex portion 711 of the first pressing member 71 through the sheet bundle.

In the second pressing member 72 of the present exemplary embodiment, each of the second convex portions 721 and the second concave portions 722 is formed by a curved surface with a curvature. Specifically, each second convex portion 721 is formed by a surface convexly curved toward the first pressing member 71 side. In addition, each second concave portion 722 is formed by a surface concavely curved in a direction away from the first pressing member 71. Accordingly, as illustrated in FIG. 4A, the second convex portion 721 and the second concave portion 722 are represented by curved lines in the cross sections thereof along the pressing direction D2 and the parallel direction E.

In addition, the cross sectional shape of each of the second convex portion 721 and the second concave portion 722 is constant from one end thereof throughout the other end thereof in the elongated direction F.

In addition, the second pressing member 72 includes second connection portions 723 that are provided between the second convex portions 721 and the second concave portions 722, and formed by a plane inclined to the pressing direction D2 and the parallel direction E.

Here, in the descriptions below, the distance in the pressing direction D2 from the boundary position between the second convex portion 721 and the second connection portion 723 to the apex of the second convex portion 721 will be referred to as a height H2*a*. Likewise, the distance in the pressing direction D2 from the boundary position between the second concave portion 722 and the second connection portion 723 to the bottom of the second concave portion 722 will be referred to as a depth H2*b*. In this example, the height H2*a* of the second convex portion 721 is smaller than the depth H2*b* of the second concave portion 722 (H2*a*<H2*b*).

In the present exemplary embodiment, the curvature of the curved surface forming the first convex portion 711 of the first pressing member 71 (hereinafter, the "curvature r1*a* of the first convex portion 711") is smaller in the pressing direction D2 than the curvature of the curved surface forming the second concave portion 722 of the second pressing member (hereinafter, the "curvature r2*b* of the second concave portion 722") (r1*a*<r2*b*). In other words, in the present exemplary embodiment, the curvature radius R1*a* of the curved surface forming the first convex portion 711 is larger than the curvature radius R2*b* of the curved surface forming the second concave portion 722 (R1*a*>R2*b*).

In the present exemplary embodiment, in the cross section along the pressing direction D2, the curvature of the curved surface forming the second convex portion 721 of the second pressing member 72 (hereinafter, the "curvature r2*a* of the second convex portion 721") is smaller than the curvature of the curved surface forming the first concave portion 712 of the first pressing member 71 (hereinafter, the "curvature r1*b* of the first concave portion 712") (r2*a*<r1*b*). In other words, in the present exemplary embodiment, the curvature radius R2*a* of the curved surface forming the second convex portion 721 is larger than the curvature radius Rib of the curved surface forming the first concave portion 712 (R2*a*>R1*b*).

In addition, in this example, the curvature r1*a* of the first convex portion 711 and the curvature r2*a* of the second convex portion 721 are equal to each other, and the curvature r1*b* of the first concave portion 712 and the curvature r2*b* of the second concave portion 722 are equal to each other (r1*a*=r2*a*, r1*b*=r2*b*). In other words, in this example, the shape of the curved surface forming the first convex portion 711 of the first pressing member 71 and the shape of the curved surface forming the second convex portion 721 of the second pressing member 72 are the same. Likewise, in this example, the shape of the curved surface forming the first concave portion 712 of the first pressing member 71 and the shape of the curved surface forming the second concave portion 722 of the second pressing member 72 are the same.

Further, in the present exemplary embodiment, the height H1*a* of the first convex portion 711 of the first pressing member 71 is smaller than the depth H2*b* of the second concave portion 722 of the second pressing member 72 (H1*a*<H2*b*). Likewise, the height H2*a* of the second convex portion 721 of the second pressing member 72 is smaller than the depth H1*b* of the first concave portion 712 of the first pressing member 71 (H2*a*<H1*b*).

In addition, as illustrated in FIG. 4B, gaps G1 and G2 are formed between the first pressing member 71 and the second pressing member 72 in the state in which the first pressing member 71 and the second pressing member 72 are combined with each other.

Specifically, for example, when the first pressing member 71 is moved to the pressing direction D2 without placing the sheet bundle between the first pressing member 71 and the second pressing member 72, the first convex portion 711 of the first pressing member 71 enters into the second concave portion 722 of the second concave member 72, and simultaneously, the second convex portion 721 of the second pressing member 72 enters into the first concave portion 712 of the first pressing member 71.

As described above, in the present exemplary embodiment, the curvature r1*a* of the first convex portion 711 is smaller than the curvature r2*b* of the second concave portion 722, and the curvature r2*a* of the second convex portion 721 is smaller than the curvature r1*b* of the first concave portion 712. Hence, when the first pressing member 71 is further moved to the pressing direction D2, the first pressing member 71 and the second pressing member 72 come in contact with each other at the first connection portion 713 and the second connection portion 723.

In addition, as described above, in the present exemplary embodiment, the height H1*a* of the first convex portion 711 is smaller than the depth H2*b* of the second concave portion 722, and the height H2*a* of the second convex portion 721 is smaller than the depth H1*b* of the first concave portion 712.

As a result, in the present exemplary embodiment, as illustrated in FIG. 4B, the gap G1 is formed as an exemplary first gap between the first convex portion 711 of the first pressing member 71 and the second concave portion 722 of the second pressing member 72, in the state in which the first pressing member 71 and the second pressing member 72 are combined with each other. Further, the gap G2 is formed as an exemplary second gap between the second convex portion 721 of the second pressing member 72 and the first concave portion 712 of the first pressing member 71. In the descriptions below, the gap G1 formed between the first convex portion 711 and the second concave portion 722 and the gap G2 formed between the second convex portion 721 and the first concave portion 712 may be collectively referred to as a "gap G."

Here, as described above, the shape of the first convex portion 711 of the first pressing member 71 and the shape of the second convex portion 721 of the second pressing member 72 are the same, and the shape of the first concave portion 712 of the first pressing member 71 and the shape of the second concave portion 722 of the second pressing member 72 are the same. Hence, the gap G1 formed between the first convex portion 711 of the first pressing member 71 and the second concave portion 722 of the second pressing member 72 and the gap G2 formed between the second convex portion 721 of the second pressing member 72 and the first concave portion 712 of the first pressing member 71 are the same in shape and volume.

Subsequently, more detailed descriptions will be made on the needle-free binding processing performed by the needle-free binding mechanism 70 of the present exemplary embodiment. FIGS. 5A to 5D are views illustrating steps of the needle-free binding processing performed in the needle-free binding mechanism 70, and enlarged views of the cross section of the needle-free binding mechanism 70 along the pressing direction D2 and the parallel direction E.

As described above, when performing the needle-free binding processing with the needle-free binding mechanism 70, sheets are stacked on the compiling tray 35 (see FIG. 2) so as to generate a sheet bundle SB, and thereafter, the first pressing member 71 is moved to the pressing direction D2 to approach the second pressing member 72. In this example, in the state in which the sheet bundle SB is generated on the compiling tray 35, the first convex portion 711 of the first pressing member 71 faces one side of the sheet bundle SB (the top side of the sheet bundle SB facing the first pressing member 71) through a gap. In addition, the second convex portion 721 of the second pressing member 72 is in contact with the other side of the sheet bundle SB (the bottom side of the sheet bundle SB facing the second pressing member 72).

Figure 5A:
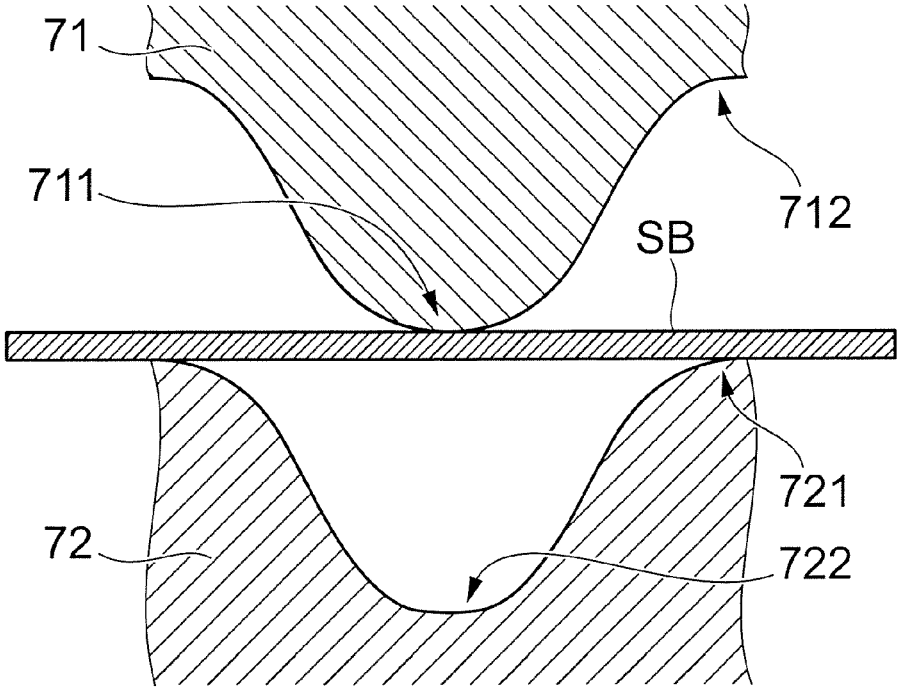
FIGS. 5A to 5D are views illustrating steps of a needle-free binding processing in the needle-free binding mechanism.

When the first pressing member 71 is moved to the pressing direction D2, the first convex portion 711 of the first pressing member 71 first comes in contact with the one side of the sheet bundle SB, as illustrated in FIG. 5A.

Figure 5B:
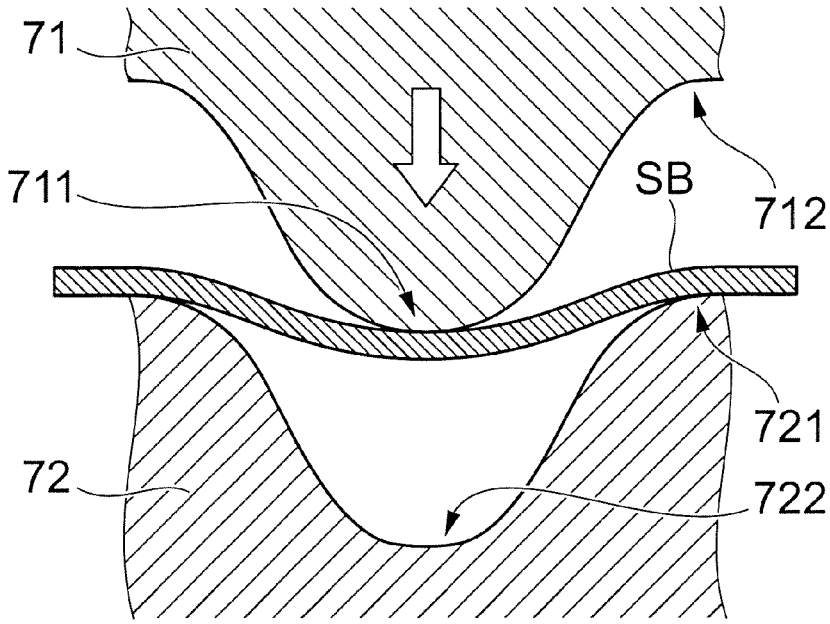

Subsequently, when the first pressing member 71 is further moved to the pressing direction D2, the sheet bundle SB is pressed by the first convex portion 711 of the first pressing member 71 so that the sheet bundle SB is deformed, as illustrated in FIG. 5B. Specifically, the part of the sheet bundle SB pressed by the first convex portion 711 is deformed along the curved surface forming the first convex portion 711 toward the second pressing member 72 side.

Subsequently, when the first pressing member 71 is further moved to the pressing direction D2, the sheet bundle SB is pressed by the first convex portion 711 of the first pressing member 71 so that the sheet bundle SB is further deformed, and some areas of the sheet bundle SB are brought into a state of being sandwiched between the first pressing member 71 and the second pressing member 72.

Figure 5C:
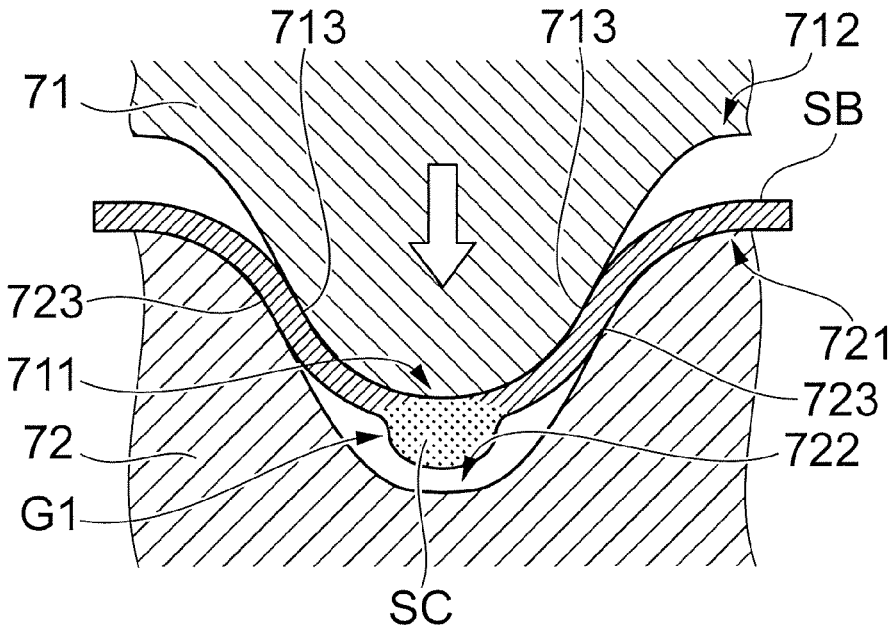

That is, as illustrated in FIG. 5C, when the distance between the first connection portion 713 of the first pressing member 71 and the second connection portion 723 of the second pressing member 72 becomes the same as the thickness of the sheet bundle SB, some areas of the sheet bundle SB are sandwiched between the first connection portion 713 and the second connection portion 723. Accordingly, the sheet bundle SB is confined so that the movement of the sheet bundle SB to the parallel direction E is suppressed.

Then, when the first pressing member 71 is further moved to the pressing direction D2 in the state in which some areas of the sheet bundle SB are sandwiched between the first pressing member 71 and the second pressing member 72, the section of the sheet bundle SB following the curved surface forming the first convex portion 711 is extended by being pressed by the first convex portion 711. More specifically, the section of the sheet bundle SB that is in contact with the first convex portion 711 is extended to be widened. Accordingly, fibers that constitute the respective sheets of the sheet bundle SB are ruptured in the section of the sheet bundle SB that is in contact with the first convex portion 711.

Here, in the needle-free binding mechanism 70 of the present exemplary embodiment, as described above, the gap G1 is formed between the first convex portion 711 and the second concave portion 722 in the state in which the first pressing member 71 and the second pressing member 72 are combined with each other. Hence, when the fibers constituting the respective sheets of the sheet bundle SB are partially ruptured, the entanglement of the fibers constituting the respective sheets is loosened so that the fibers protrude into the gap G1. As a result, as illustrated in FIG. 5C, a ruptured section SC with the increased thickness of each sheet of the sheet bundle is formed in the sheet bundle SB.

Figure 5D:
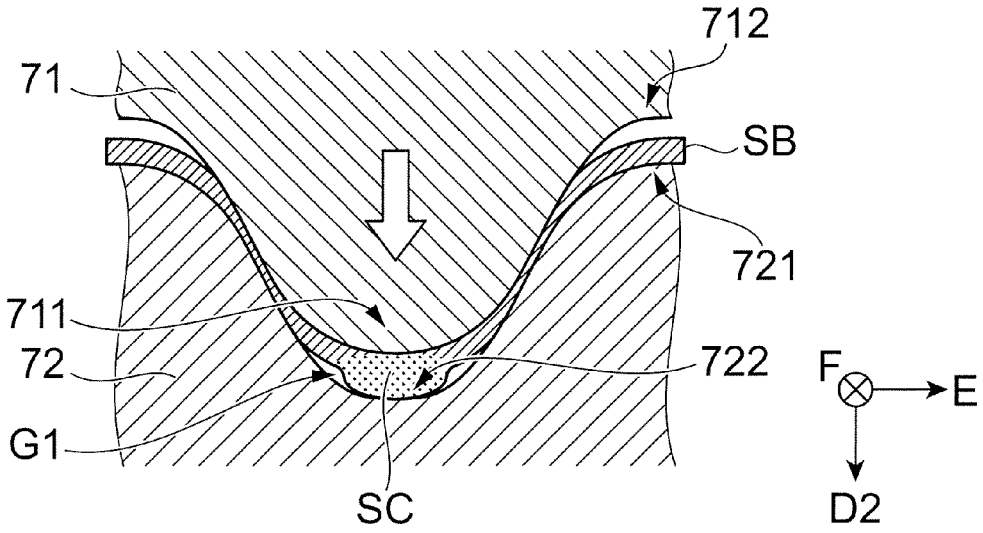

Subsequently, when the first pressing member 71 is further moved to the pressing direction D2, the volume of the gap G1 formed between the first convex portion 711 and the second concave portion 722 is gradually reduced. Accordingly, as illustrated in FIG. 5D, the ruptured section SC formed in the sheet bundle SB is sandwiched and pressed between the first convex portion 711 and the second concave portion 722. As a result, in the ruptured section SC, the fibers of each sheet of which the entanglement has been loosened are entangled with the fibers of adjacent sheets so that the respective sheets of the sheet bundle SB are press-bonded to each other.

Here, in the needle-free binding mechanism 70 of the present exemplary embodiment, as described above, both the first convex portion 711 of the first pressing member 71 and the second concave portion 722 of the second pressing member 72 are formed by curved surfaces each having a curvature. Accordingly, for example, when the ruptured section SC is pressed by the first convex portion 711 and the second concave portion 722, a large pressure is suppressed from being locally applied to the sheet bundle SB, compared to, for example, a case where the first convex portion 711 or the second concave portion 722 has an angled part. As a result, a pressure may be uniformly applied to the ruptured section SC of the sheet bundle SB so that the cracked fibers of the sheets in the ruptured section SC may be effectively entangled with each other.

Further, for example, when the ruptured section SC is pressed by the first convex portion 711 and the second concave portion 722, a large damage or tearing is suppressed from occurring in the respective sheets that constitute the sheet bundle SB.

With respect to FIGS. 5A to 5D, the state of the sheet bundle SB between the first convex portion 711 of the first pressing member 71 and the second concave portion 722 of the second pressing member 72 has been described. However, the respective sheets of the sheet bundle SB are also press-bonded to each other between the second convex portion 721 of the second pressing member 72 and the first concave portion 712 of the first pressing member 71 in the same manner as described above.

Figure 6:
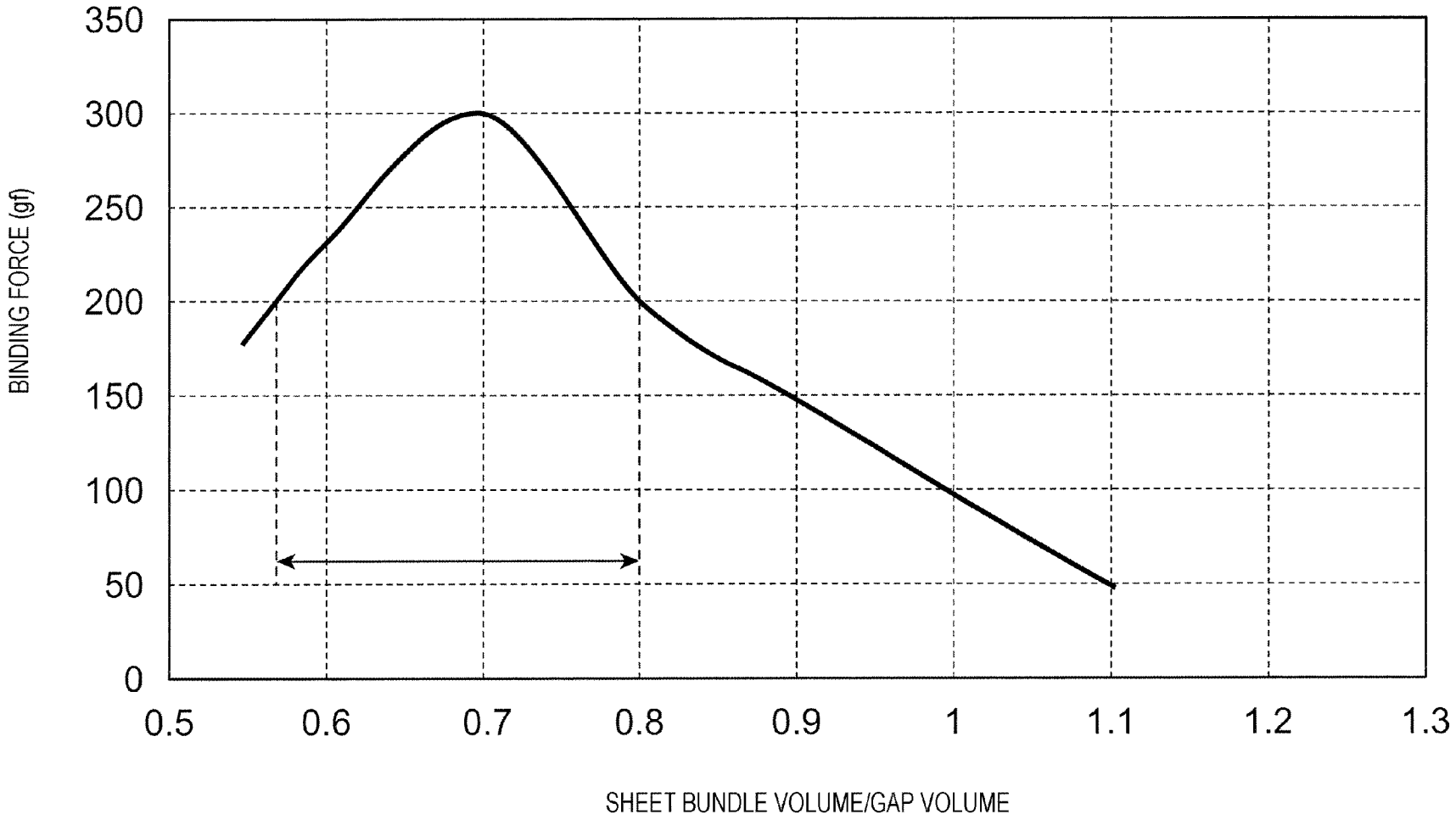
FIG. 6 is a view illustrating a relationship between a ratio of a volume of a sheet bundle (sheets) to a volume of a gap and a binding force of the sheet bundle after the binding processing is performed.

Subsequently, descriptions will be made on the size of the gap G formed between the first pressing member 71 and the second pressing member 72 in the needle-free binding mechanism 70 of the present exemplary embodiment. FIG. 6 is a view illustrating a relationship between a ratio of the volume of the sheet bundle (sheets) to the volume of the gap G and the binding force of the sheet bundle after the binding processing is performed.

Here, the volume of the gap G means the volume of the gap G formed between the pair of the first convex portion 711 (or the second convex portion 721) and the second concave portion 722 (or the first concave portion 712) when the first pressing member 71 and the second pressing member 72 are combined with each other. More specifically, the volume of the gap G means the volume of the gap G formed between the first convex portion 711 and the second concave portion 722 in the state in which the sheet bundle is press-bonded by the pair of the first convex portion 711 (the second convex portion 721) and the second concave portion 722 (the first concave portion 712) (the state illustrated in FIG. 5D).

The volume of the sheet bundle means the volume of the sheet bundle (sheets) in the area thereof sandwiched between the pair of the first convex portion 711 and the second concave portion 722. Here, the volume of the sheet bundle refers to the volume of the sheet bundle before the fibers that constitute the respective sheets are ruptured to form the ruptured section SC. In addition, in FIG. 6, it is assumed that five (5) plain sheets are stacked as the sheet bundle.

In FIG. 6, when the ratio of the volume of the sheet bundle to the volume of the gap G (hereinafter, the "volume ratio of the sheet bundle and the gap G") is 1 or more, it means a state in which no gap G is formed when the sheet bundle is sandwiched between the first convex portion 711 and the second concave portion 722.

As illustrated in FIG. 6, in the needle-free binding mechanism 70, when the volume ratio of the sheet bundle and the gap G is less than 1, the binding force of the sheet bundle increases, compared to a case where the volume ratio of the sheet bundle and the gap G is 1 or more. In other words, the binding force of the sheet bundle increases when the volume of the gap G is larger than the volume of the sheet bundle. Further, in the needle-free binding mechanism 70, it is preferable that the volume ratio of the sheet bundle and the gap G is in a range of 0.56 or more to 0.8 or less so that the binding force of the sheet bundle increases to 200 gf or higher.

In contrast, for example, when the volume ratio of the sheet bundle and the gap G is excessively high or excessively low, the binding force of the sheet bundle tends to decrease.

It is considered that when the volume ratio of the sheet bundle and the gap G is excessively high, the gap G is smaller with respect to the sheet bundle, and therefore, fibers of the respective sheets that constitute the sheet bundle hardly protrude into the gap G when the fibers are ruptured and crushed, so that the ruptured section SC where the entanglement of the fibers is loosened is hardly formed.

Meanwhile, it is considered that when the volume ratio of the sheet bundle and the gap G is excessively low, the gap G is larger with respect to the sheet bundle so that after the ruptured section SC is formed, it is difficult to press the ruptured section SC by the first convex portion 711 and the second concave portion 722 to cause the sheets be press-bonded to each other.

Exemplary Embodiment 2

Figure 7:
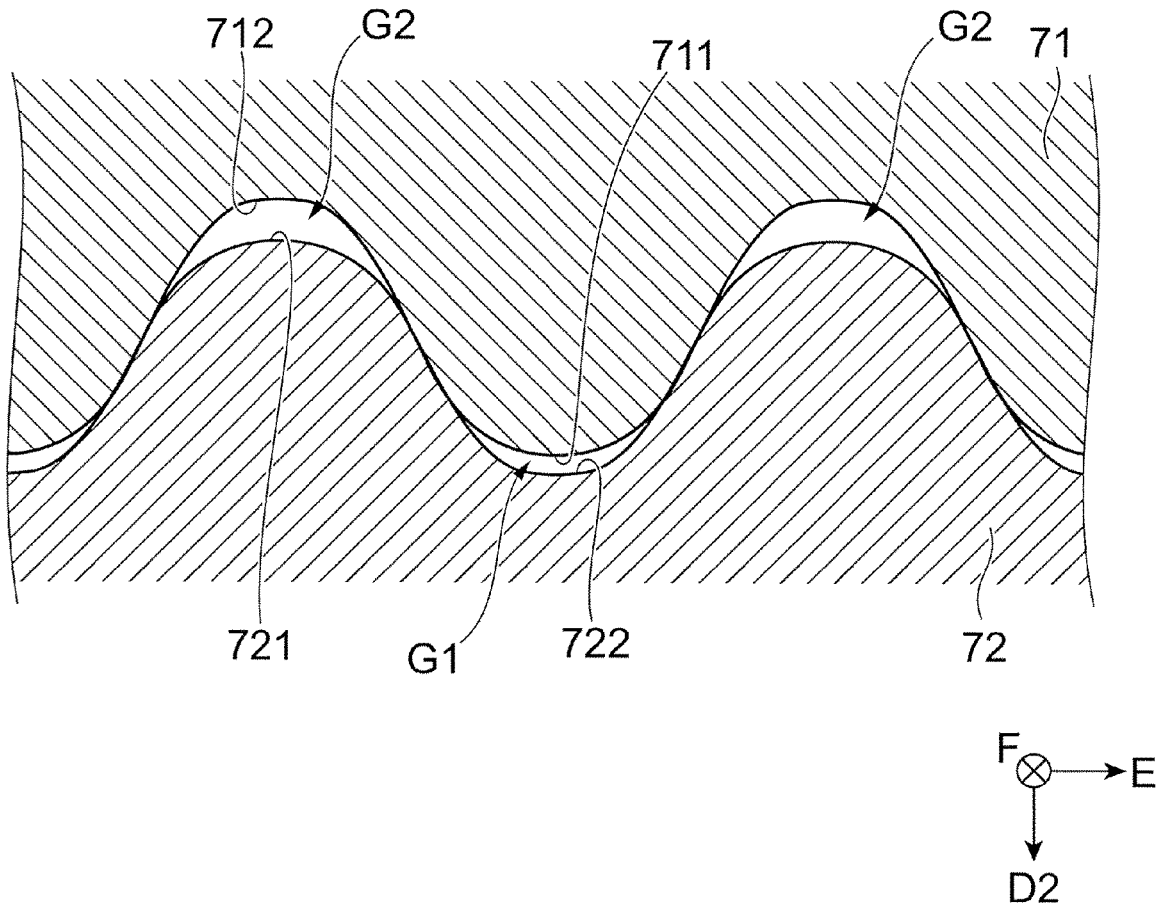
FIG. 7 is a view illustrating a configuration of a needle-free binding mechanism to which Exemplary Embodiment 2 of the present invention is applied.

Subsequently, Exemplary Embodiment 2 of the present invention will be described. FIG. 7 is a view illustrating a configuration of a needle-free binding mechanism 70 to which Exemplary Embodiment 2 is applied, and an enlarged view of the needle-free binding mechanism 70 along the pressing direction D2 and the parallel direction E. In the descriptions below, components which are identical to those in Exemplary Embodiment 1 will be denoted by the same reference numerals as used in Exemplary Embodiment 1, and detailed descriptions thereof will be omitted.

As illustrated in FIG. 7, the needle-free binding mechanism 70 of Exemplary Embodiment 2 includes a first pressing member 71 and a second pressing member 72. As in Exemplary Embodiment 1, the first pressing member 71 includes plural first convex portions 711 and plural first concave portions 712, and the second pressing member 72 includes plural second convex portions 721 and plural second concave portions 722.

Here, in Exemplary Embodiment 1, the gap G1 formed between the first convex portion 711 of the first pressing member 71 and the second concave portion 722 of the second pressing member 72 and the gap G2 formed between the second convex portion 721 of the second pressing member 72 and the first concave portion 712 of the first pressing member 71 are the same in volume.

In contrast, in the needle-free binding mechanism 70 of Exemplary Embodiment 2, the gap G1 formed between the first convex portion 711 of the first pressing member 71 and the second concave portion 722 of the second pressing member 72 and the gap G2 formed between the second convex portion 721 of the second pressing member 72 and the first concave portion 712 of the first pressing member 71 are different from each other in volume.

Specifically, in the needle-free binding mechanism 70 of Exemplary Embodiment 2, the curvature r1*b* of the curved surface forming the first concave portion 712 of the first pressing member 71 and the curvature r2*b* of the curved surface forming the second concave portion 722 of the second pressing member 72 are different from each other. In this example, the curvature r1*b* of the first concave portion 712 is larger than the curvature r2*b* of the second concave portion 722 (r1*b*>r2*b*). In other words, the curvature radius Rib of the first concave portion 712 is smaller than the curvature radius R2*b* of the second concave portion 722 (R1*a*>R2*b*).

In addition, in this example, as in Exemplary Embodiment 1, the curvature r1*a* of the first convex portion 711 of the first pressing member 71 and the curvature r2*a* of the second convex portion 721 of the second pressing member 72 are equal to each other (r1*a*=r2*a*), as in Exemplary Embodiment 1. Further, as in Exemplary Embodiment 1, the curvature r1*a* of the first convex portion 711 is smaller than the curvature r2*b* of the second concave portion 722 (r1*a*<r2*b*), and the curvature r2*a* of the second convex portion 721 is smaller than the curvature r1*b* of the first concave portion 712 (r2*a*<r1*b*).

In the needle-free binding mechanism 70 of Exemplary Embodiment 2, as illustrated in FIG. 7, the gap G1 formed between the first convex portion 711 and the second concave portion 722 and the gap G2 formed between the second convex portion 721 and the first concave portion 712 are different from each other in shape and volume, in the state in which the first pressing member 71 and the second pressing member 72 are combined with each other. Specifically, the gap G2 formed between the second convex portion 721 and the first concave portion 712 is larger in volume than the gap G1 formed between the first convex portion 711 and the second concave portion 722.

Here, as described above with respect to FIG. 6 of Exemplary Embodiment 1, the binding force of the sheet bundle bound by the needle-free binding mechanism 70 is different depending on a ratio of the volume of the sheet bundle to the volume of the gap G formed between the first pressing member 71 and the second pressing member 72 (the volume ratio of the sheet bundle and the gap G).

In Exemplary Embodiment 2, the volume of the gap G1 formed between the first convex portion 711 and the second concave portion 722 and the volume of the gap G2 formed between the second convex portion 721 and the first concave portion 712 are different from each other so that at least one of the gap G1 and the gap G2 easily falls within a preferred range of the volume ratio of the sheet bundle and the gap G (e.g., a range of 0.56 or more and 0.8 or less).

Accordingly, even when, for example, the thickness of the sheets that constitute the sheet bundle or the number of the sheets to be stacked varies, it is possible to bind the sheet bundle with a strong binding force in at least one side of the gap G1 and the gap G2, compared to the case where the gap G1 and the gap G2 are the same in volume. In other words, the reduction of the binding force of the sheet bundle is suppressed after the binding processing is performed by the needle-free binding mechanism 70.

In addition, in Exemplary Embodiments 1 and 2, the configuration has been described in which the gap G is formed in both the space between the first convex portion 711 and the second concave portion 722 and the space between the second convex portion 721 and the first concave portion 712. However, the gap G may be formed in only one of the spaces. In this case, since the area of the section SC, in which the fibers of the sheets in the sheet bundle SB are partially ruptured, is reduced, it is possible to suppress a strength reduction or tearing of the sheet bundle SB, for example, when the sheets of the sheet bundle SB is thin.

Further, in the needle-free binding mechanism 70, the curved surface of each of the first convex portion 711, the first concave portion 712, the second convex portion 721, and the second concave portion 722 may not be required to have a constant curvature over the entire area thereof, and the curvature may not be required to have the above-described relationship over the entire portions. That is, the shape of the curved surface is not limited to that described above as long as the shape enables the gap G for forming the ruptured section SC to be formed between the first convex portion 711 and the second concave portion 722 and/or between the second convex portion 721 and the first concave portion 712 in a state where the first pressing member 71 and the second pressing member 72 are combined with each other.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A binding processing device comprising:

a first pressing member including:

a first convex portion;

a first concave portion; and a first connection portion which is provided between the first convex portion and the first concave portion; and a second pressing member including:

a second convex portion;

a second concave portion; and a second connection portion which is provided between the second convex portion and the second concave portion, wherein, in a state in which the first convex portion of the first pressing member and the second concave portion of the second pressing member come in contact with each other at the first connection portion and the second connection portion, the first connection portion contacts with the second connection portion and a gap is formed between the first convex portion and the second concave portion along a pressing direction of the first and second pressing members, wherein in a state in which a sheet bundle is sandwiched between the first pressing member and the second pressing member, an increased section having an increased thickness of each sheet of the sheet bundle of the sheet bundle is formed in the gap, the increased section being formed by fibers of the sheet bundle being loosened by a partial rupture of the sheet bundle, and wherein the increased section is pressed by the first convex portion and the second concave portion, and wherein a curvature radius of the first convex portion is larger than a curvature radius of the second concave portion, and wherein a height of the first convex portion is smaller than a height of the first concave portion.

2. The binding processing device according to claim 1, wherein the first connection portion formed along a plane inclined to the pressing direction and a second direction perpendicular to the pressing direction.

3. The binding processing device according to claim 1, wherein in the state in which the sheet bundle is sandwiched between the first pressing member and the second pressing member, the fibers being loosened are entangled with the fibers of adjacent sheets to be press-bonded.

4. The binding processing device according to claim 1, wherein the fibers forms the increased section by the loosened fibers protruding from the sheet bundle.

5. The binding processing device according to claim 1, wherein a ratio of a volume of the sheet bundle sandwiched between the first convex portion and the second concave portion to a volume of the gap formed between the first convex portion and the second concave portion is in a range of 0.56 to 0.80.

* * * * *